US006948616B2

(12) United States Patent
Gillani

(10) Patent No.: US 6,948,616 B2
(45) Date of Patent: Sep. 27, 2005

(54) REVERSIBLE CONTAINER WITH LOGO CONCEALMENT

(76) Inventor: Shiraz Gillani, 2 Winchester Dr., Muttontown, NY (US) 11545

( * ) Notice: Subject to any disclaimer, the term of this patent is extended or adjusted under 35 U.S.C. 154(b) by 105 days.

(21) Appl. No.: 10/237,237

(22) Filed: Sep. 9, 2002

(65) Prior Publication Data

US 2004/0045857 A1 Mar. 11, 2004

(51) Int. Cl.[7] ..... B65D 85/00; G09F 3/00
(52) U.S. Cl. ..... 206/459.5; 40/312; 229/117.24
(58) Field of Search ..... 206/459.5, 459.1; 40/312; 229/117.24, 190, 193

(56) References Cited

U.S. PATENT DOCUMENTS

| | | | | | |
|---|---|---|---|---|---|
| 1,148,219 | A | | 7/1915 | Cornell | |
| 1,509,383 | A | | 9/1924 | Walter | |
| 1,581,800 | A | * | 4/1926 | Henry | 229/117.24 |
| 2,218,360 | A | | 10/1940 | Rokol | |
| 2,795,368 | A | * | 6/1957 | Caster et al. | 229/117.12 |
| 3,269,637 | A | * | 8/1966 | Whittaker | 229/117.05 |
| 3,355,086 | A | * | 11/1967 | Ingle | 229/117.19 |
| 4,339,069 | A | | 7/1982 | Poteet | 229/36 |
| 4,403,729 | A | | 9/1983 | Wytko | 229/39 R |
| 4,622,768 | A | | 11/1986 | Moreau | 40/124.1 |
| 4,953,779 | A | * | 9/1990 | Densen | 229/125.19 |
| 5,000,377 | A | | 3/1991 | McClure | |
| 5,007,580 | A | | 4/1991 | Morrison | 229/117.17 |
| 5,181,277 | A | | 1/1993 | Sherman | 2/195 |
| 5,228,617 | A | * | 7/1993 | McGrath | 229/127 |
| 5,236,122 | A | | 8/1993 | Ballard | 229/102 |
| 5,476,218 | A | | 12/1995 | Reisman | 229/123 |
| 5,494,214 | A | | 2/1996 | Fleury et al. | 229/149 |
| 5,588,585 | A | | 12/1996 | McClure | 229/191 |
| 5,871,142 | A | | 2/1999 | Josephson | 229/120.09 |
| 5,943,698 | A | | 8/1999 | Blanks | 2/69 |
| 2002/0134822 | A1 | * | 9/2002 | Mills | 229/103.3 |

* cited by examiner

*Primary Examiner*—Bryon P. Gehman

(57) ABSTRACT

A reversible shipping container contains a plurality of panels which can be alternately folded respective mirror image configurations, to alternately reveal or conceal a commercial logo or other visible marking.

21 Claims, 3 Drawing Sheets

REVERSIBLE CONTAINER WITH LOGO CONCEALMENT

FIELD OF THE INVENTION

The present invention relates to courier packages with optionally revealed or concealed business logos.

BACKGROUND OF THE INVENTION

In order to transport sensitive business documents or medical specimens, there is often a need to conceal the identity of the sender from the general public, such as in crowded public spaces or mass transportation facilities, in order to preserve confidentiality and privacy. Presently, such requirements result in the need for duplicate carton containers: one with a business logo and one with blank fascia.

Furthermore, with today's rapid shipping requirements, there is also a need for quickly assembled cartons from flat cardboard or other substrates.

Such foldable containers are disclosed in U.S. Pat. Nos. 1,148,219 of Cornell for a folding box, 1,509,383 of Walter for a box, 2,218,360 of Rokol for a foldable market basket, 4,339,069 of Poteet for a knockdown file box, 4,403,729 of Wytko for a file folder box, 5,000,377 of McClure for a corner reinforced carton, 5,007,580 of Morrison for a foldable container, 5,236,122 of Ballard for a lockable container, 5,476,218 of Reisman for a card file box, 5,494,214 of Fleury for a foldable postal mail tray, 5,588,585 also of McClure for a corner-reinforced carton and 5,871,142 of Josephson for a foldable, clasp-closable brief case documents container with indicia, such as company logos or promotional material on an exterior surface thereof.

Furthermore, reversible products are disclosed in U.S. Pat. No. 4,622,768 of Moreau for a reversible greeting card. U.S. Pat. No. 5,943,698 of Blanks discloses an article of apparel, such as a shirt which is reversible to alternatively reveal different images. In addition, U.S. Pat. No. 5,181,277 of Sherman discloses a reversible hat with an interchangeable sweatband.

However, the prior art fails to disclose a reversible foldable container carton which can be reversed to alternatively reveal or conceal a business logo on an exterior surface thereof.

OBJECTS OF THE INVENTION

It is therefore an object of the present invention to provide a reversible foldable container carton which can be reversed to conceal or reveal a business logo on an exterior surface thereof.

It is also an object of the present invention to improve over the disadvantages of the prior art.

SUMMARY OF THE INVENTION

In keeping with these objects and others which may become apparent, the present invention discloses a foldable carton container which is mirror-reversible, so that one side of the carton container displays a company logo, but the reverse side is blank, to alternatively hide the logo for confidentiality reasons, such as where secrecy during transport is of paramount importance.

The shipping container of the present invention is made of corrugated cardboard or corrugated plastic. Any other substantially flat resilient material which can cut into a pattern for creating a reversible container that is also crush-resistant can be also used; such as flexible metals, alloys, synthetic and natural treated fabrics, paper or paper board stock.

In one embodiment, one side of the carton container has visible images, such as logos or writing on one exterior surface, with the reversed side being provided in blank.

An optional handle can be provided to carry the carton container.

The carton container is made of plurality of scored, connected panels with locking members used to lock the top shut when the locking members are inserted into slots at either side of the panels of the carton container.

Creasing is used along fold score lines so that the panels can be easily folded along the crease lines in either reversible direction with ease. The logo and all other images are printed only on one side so that the carton container can be assembled with the markings visible from the exterior, or if the reversible folding leaves the logo and other distinctive markings on the inner surfaces, the container appears blank with no logo on the exterior.

In an alternate embodiment, two different logos can be used on the two surfaces to disguise the contents or otherwise show alternative logos on the carton container.

To assemble the reversible carton container, the respective panels are folded up, and then the panels are folded in place at 90 degrees. Locking panels are also folded in to secure the container, and locking tabs lock in place in respective slots.

Handle tabs are inserted in pairs of holes to support the handle up into an arched position for manual grabbing. To force the flexible handle into an arched position, the distance between the respective holes is less than the length of the handle, thus compelling the handle to arch upward when the tabs at the respective ends of the handle are inserted in the tabs holes in the panel top carton of the container. The container carton is filled, before it is completely closed, in either optional configuration: with or without the logo exposed.

BRIEF DESCRIPTION OF THE DRAWINGS

The present invention can best be understood in conjunction with the accompanying drawings, in which.

DETAILED DESCRIPTION OF THE INVENTION

Although the illustrated material is corrugated cardboard which is commonly used for shipping containers, a more durable container can be built of corrugated plastic. Any substantially flat resilient material amenable to die cutting and die creasing is suitable for this invention.

Figure 1:
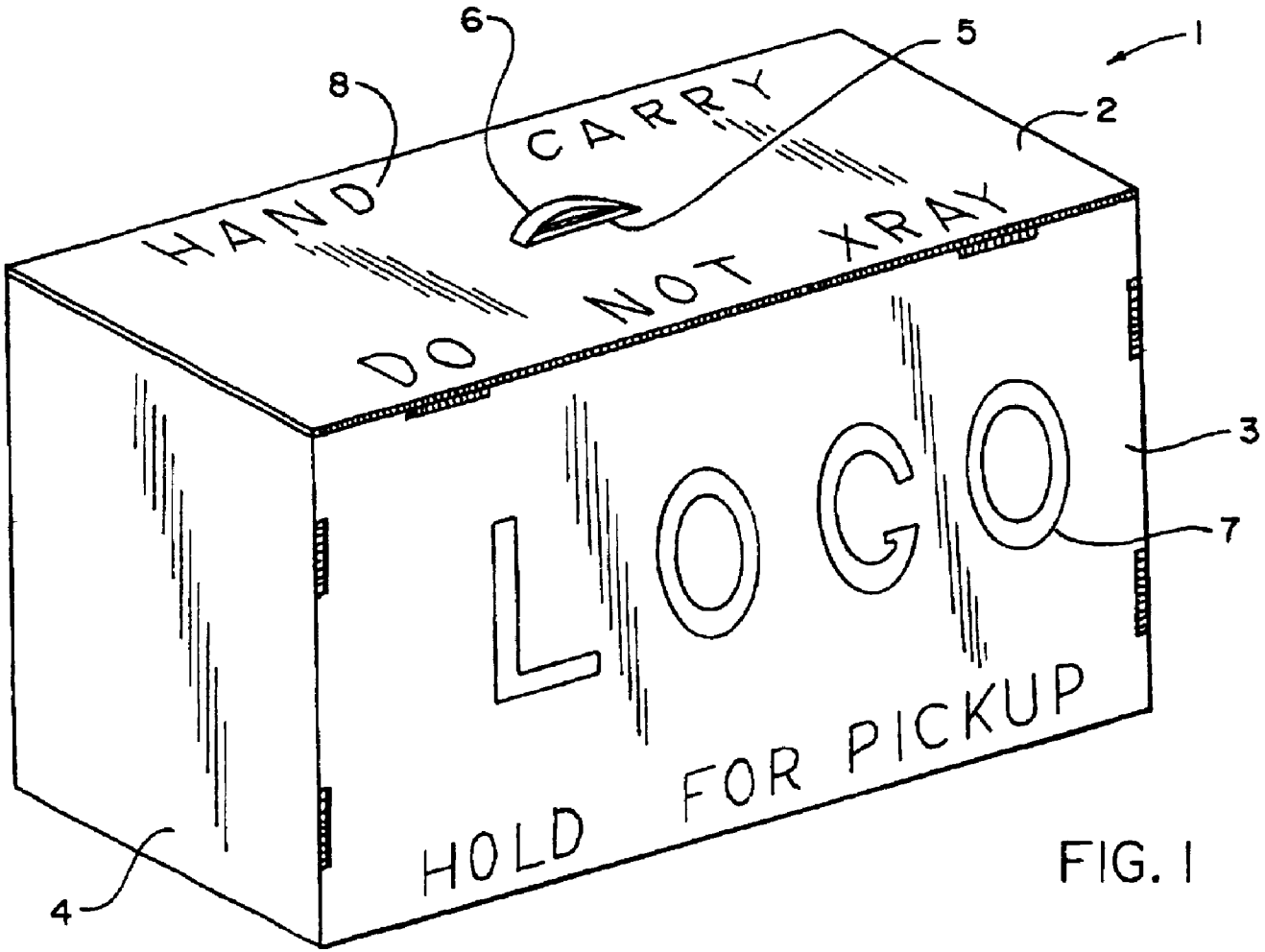
FIG. 1 is an isometric view of a closed container of this invention.

FIG. 1 shows a closed assembled reversible container 1 with visible writing 8 on the surface of top 2 and a visible logo 7 on front panel 3. Furthermore, the position of the indicia can be on any side panel 4 is visible in FIG. 1. Handle opening 5 in top panel 2 permits handle 6 to protrude for use.

Figure 2:
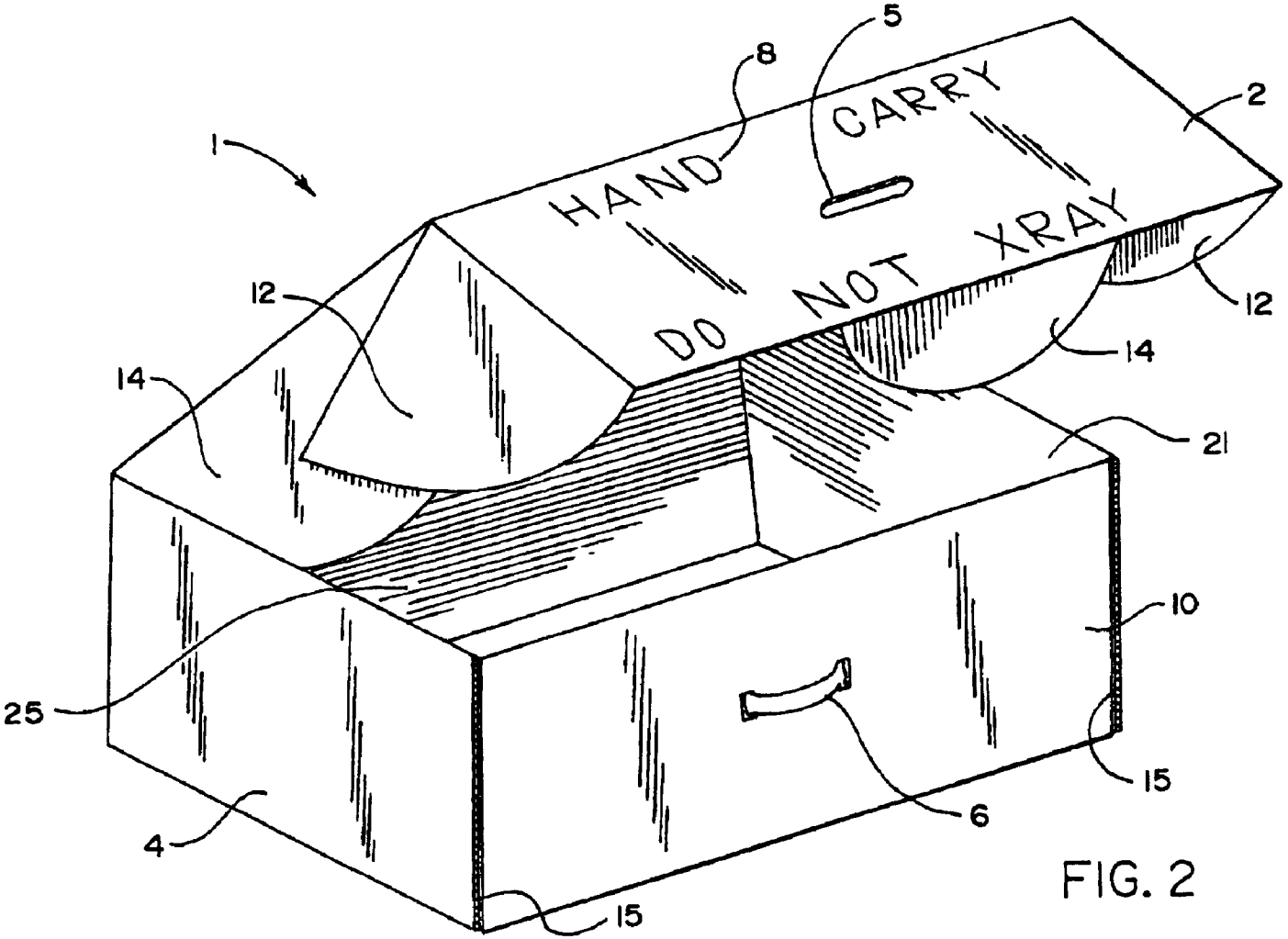
FIG. 2 is an isometric view of a partially opened container as in FIG. 1.

FIG. 2 shows this sturdy container in a different orientation resting on front panel 3 (not visible). The top panel 2 is partially open revealing more construction features. The single layer panel 25 is visible as is the inner side panel 21. Inner side guidance panels 14 offer more rigidity and support, while locking members 12 are designed to lock top 2 shut when inserted into slots 15 at either side of double inner top panel 10 which also anchors handle 6.

Figure 3:
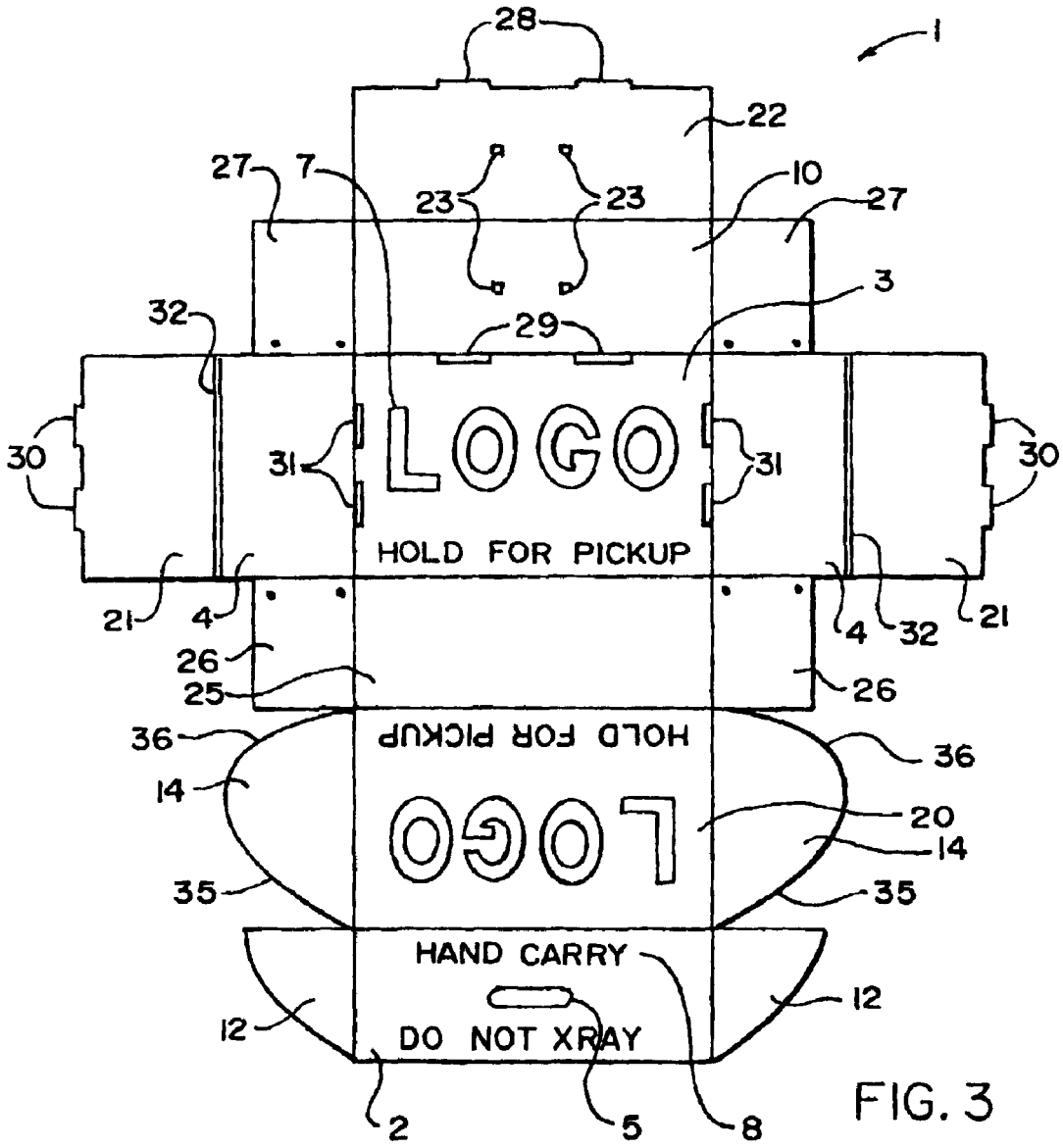
FIG. 3 is a top plan view of the flat die cut container of the present invention, prior to assembly.

The flat container 1 prior to assembly is shown in FIG. 3. The outer contour is die cut usually with a steel rule die. Internal features are also cut in the same pass, such as the four lines marked "c c" as well as holes 23 for anchoring handle 6, and rectangular tab holes 29 and 31. The creasing is also performed by non-cutting die members in the same pass.

To make container 1 reversible, all other lines denote creasing on both top and bottom surfaces such that the panel members 2, 3, 4, 10, 20, 21 and 25 can be easily folded along their respective crease fold lines in either direction with equivalent ease.

To permit alternative exposure concealment of logo 7, and all other markings are printed only on one side so that container 1 may be assembled with the markings visible from the exterior as shown in FIGS. 1, and 2, or if the folding process is such that the logo 7 and other distinctive markings are on the inner surfaces, the container 1 appears blank from the exterior.

Alternatively, two completely different markings (not shown) can be used on the two surfaces to disguise the contents or otherwise support alternative use of container 1.

Figure 4:
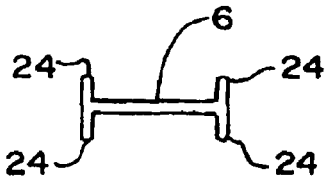
FIG. 4 is a top plan view of a flexible handle insert for use with the container of the present invention.

FIG. 4 shows a top view of resilient handle 6; made of a material such as plastic or reinforced fabric, Tabs 24 of handle 6 are guided through holes 23 in the double panel formed from panels 22 and 10 to retain handle 6. The double crease 32 spaces outer side panels 4 from inner panels 21 such as to form slots 15 for accepting locking members 12.

Inner side guidance panels 14 have a different curved outer contour 35 and inner contour 36. The smoother, larger radius of curvature of contour 35 of inner side guidance panels 14 permits the relief necessary for easy closure of hinged back 20 while the more tighter, smaller radius of curvature of the more abrupt curvature of contour 36 of guidance panel 14 more closely matches the vertical wall, offering more support and crush resistance to the hinged rear panel.

Although assembly can progress in different sequences, the first step is to decide whether the logo 7 is to be visible from the exterior of container 1. If logo 7 is to be visible, then it should be "face down"; otherwise the process starts with logo 7 face up.

Panel 10 is then folded up 90 degrees, then panel 22 is folded over such that tabs 28 are locked in holes 29. Panels 27 are folded in. Panel 25 is folded up, and then panels 26 are folded in. At this point, panels 4 are folded up 90 degrees, then panels 21 are folded in capturing panels 26 and 27 before locking tabs 30 in holes 31.

Tabs 24 are inserted in holes 23, which have now double material thickness by virtue of panels 22 and 10 being adjacent to each other) from the outside, thereby attaching handle 6 in an arched position. Container 1 is thereby ready to accept its contents before hinged back 20 and top 2 are closed with the orientation of panels 14 and 12 as shown in FIG. 2.

The final step is to lock in top 2 by inserting locking panels 12 in slots 15, adjacent to the edges between panel 4 and the respective edges of panel 10, so that top 2 lays over panel 10 in the closed position.

It is further noted that other modifications may be made to the present invention, such as different configurations for the foldable panels, so long as the modifications are made within the scope of the present invention, as noted in the appended claims.

I claim:

1. A reversible shipping container comprising:

a plurality of adjacent alternatively foldable panels foldable into an assembled single container having a first appearance from a mirror image reversible single sheet of substantially flat resilient material, wherein said mirror image reversible single sheet has a mirror image configuration for folding said mirror image reversible single sheet into said container to have a second appearance, said panels joinable by reversible creases along common fold line edges, said panels bearing at least one visible marking imprinted on one surface thereof so that said at least one visible marking conveys at least one image, said panels bearing another surface on a reversed side thereof, so that alternatively said at least one visible marking is visible when said at least one visible marking is exposed on an outer surface of said container, and concealed from viewing when said at least one visible marking is concealed on an inner reversed surface of said container, and inner side guidance panels attached to a back panel of said panels at opposite sides thereof, said side guidance panels providing structural rigidity and support to said container, wherein said inner side guidance panels have a first outer contour partially extending along a first portion of an outer edge of each said inner side guidance panel, and a second inner contour partially extending along a second portion of said outer edge of said inner side guidance panel, said first outer contour has a larger radius of contour than said second inner contour.

2. The container as in claim 1 wherein said inner reversed side of said container is a blank surface.

3. The container as in claim 1 wherein different visible markings are imprinted on said outer surface and said inner reversed surface of said panels.

4. The container as in claim 1 wherein said plurality of panels includes a top panel joined along a common crease to back panel, said back panel joined along an opposite common crease to a bottom panel, said bottom panel joined to a front panel along a first further common crease, said front panel having a pair of sub-panels, said sub-panels joinable at a second further common crease to said front panel, said sub-panels foldable adjacent to each other for supporting said top panel thereon, said sub-panels having at least one locking tab insertable within at least one respective slot within said front panel, said front panel further having at opposite front and rear edges respective pairs of side panels, each said pair of side panels foldable along third further common creases.

5. The container as in claim 4 further comprising locking panels locking said top panel shut when said locking panels are inserted into slots adjacent to edges between said side panel and said sub-panels at either side of said top panel.

6. The container as in claim 4 wherein said container is made of corrugated cardboard.

7. The container as in claim 4 wherein said container is made of a corrugated plastic.

8. The container as in claim 4, wherein said container is made of a flat resilient material.

9. The container as in claim 4 wherein one of said sub-panels is an outer most side panel having said least one locking tab insertable within at least one respective slot in said front panel.

10. The container as on claim 1 further comprising a handle detachably mounted to said container.

11. The container as in claim 10 wherein said handle includes a plurality of tabs insertable within at least one top panel of said panels of said assembled container, said tabs having a predetermined distance between said tabs greater than a predetermined length of said handle, whereupon insertion of said handle tabs in respective holes in said sub-panels below in said top panel of said container causes said handle to arch upward.

12. The container as in claim 1 wherein said first outer contour is smoother than said second inner contour, permitting relief necessary for easy closure of said rear panel.

13. The container as in claim 12 wherein said second inner contour is tighter and more abrupt than said smoother first outer contour, thereby providing structural support and crush resistance to said rear panel.

14. The container as in claim 1 wherein said panels are folded along respective crease lines in either direction.

15. The container as in claim 14 further comprising:

side outer side panels;

inner side panels; and a double crease spacing between said side outer side panels and said inner side panels.

16. A reversible shipping container comprising:

a plurality of adjacent alternatively foldable panels foldable into an assembled single container having a first appearance from a mirror image reversible single sheet of substantially flat resilient material, wherein said mirror image reversible single sheet has a mirror image configuration for folding said mirror image reversible single sheet into said container to have a second appearance, said panels joined by reversible creases along common fold line edges, said panels bearing at least one visible marking imprinted on one surface thereof so that said at least one visible marking conveys at least one image, said panels bearing another surface on a reversed side thereof, so that alternatively said at least one visible marking is visible when said at least one visible marking is exposed on an outer surface of said container, and concealed from viewing when said at least one visible marking is concealed on an inner reversed surface of said container, wherein said plurality of panels includes a top panel joined along a common crease to a back panel, said back panel joined along an opposite common crease to a bottom panel, said bottom panel joined to a front panel along a first further common crease, said front panel having a pair of sub-panels, said sub-panels joined at a second further common crease to said front panel, said sub-panels foldable adjacent to each other for supporting said top panel thereon, said sub-panels having at least one locking tab insertable within at least one respective slot within said front panel, and said front panel further having at opposite front and rear edges respective pairs of side panels, each said pair of side panels foldable along third further common creases.

17. The container as in claim 16 further comprising locking panels locking said top panel shut when said locking panels are inserted into slots adjacent to edges between said side panels and said sub-panels, at either side of said top panel.

18. The container as in claim 16 wherein said container is made of corrugated cardboard.

19. The container as in claim 16 wherein said container is made of a corrugated plastic.

20. The container as in claim 16 wherein said container is made of a flat resilient material.

21. The container as in claim 16 wherein one of said sub-panels is an outer most side panel having said least one locking tab insertable within at least one respective slot in said front panel.

* * * * *